United States Patent [19]

Boyle

[11] Patent Number: 5,031,382

[45] Date of Patent: Jul. 16, 1991

[54] RETURN CARD SYSTEM

[75] Inventor: Donald A. Boyle, Springhouse, Pa.

[73] Assignee: American Mail Systems, Inc., Springhouse, Pa.

[21] Appl. No.: 447,217

[22] Filed: Dec. 7, 1989

[51] Int. Cl.[5] ..... B65B 61/26; B65D 27/10

[52] U.S. Cl. ..... 53/411; 53/460; 229/73; 493/216

[58] Field of Search ..... 493/216, 921, 919; 53/460, 206, 411, 131; 229/92.3, 73

[56] References Cited

U.S. PATENT DOCUMENTS

| | | | |
|---|---|---|---|
| Re. 25,872 | 5/1964 | O'Gorman . | |
| 3,111,258 | 11/1963 | Perlstein | 229/92.3 |
| 3,143,279 | 8/1964 | Black | 229/73 |
| 3,273,785 | 9/1966 | Beckman et al. | 229/69 |
| 3,288,350 | 11/1966 | Kushner | 229/70 |
| 3,508,702 | 4/1970 | Kaiser | 229/71 |
| 3,612,390 | 10/1971 | Howard | 229/69 |
| 3,618,284 | 11/1971 | Gendron | 493/216 X |
| 3,722,787 | 3/1973 | Buchheit | 229/92.3 |
| 3,726,471 | 4/1973 | Kalb | 229/92.8 |
| 3,820,447 | 6/1974 | Gendron et al. | 493/216 X |
| 3,837,565 | 9/1974 | Johnsen | 229/68 R |
| 3,863,835 | 2/1975 | Gendron | 229/69 |
| 3,912,160 | 10/1975 | Gendron | 229/69 |
| 3,955,750 | 5/1976 | Huffman | 229/69 |
| 4,102,489 | 7/1978 | Lucas | 229/73 |
| 4,148,430 | 4/1979 | Drake | 229/69 |

*Primary Examiner*—James F. Coan

*Attorney, Agent, or Firm*—Eckert Seamans Cherin & Mellott

[57] ABSTRACT

A combined letter and return card system is disclosed. A sheet of letterhead stock is provided with an opening near the upper left of the sheet in the position where the recipient's inside address is normally typed. A preprinted return card is affixed to the reverse side of the sheet in position to rearwardly overfit the window opening. A space for applying the recipient's address on the return card is exposed through the opening. The return card includes a perforated tear strip which is secured to the reverse side of the letterhead sheet by employing a continuous stripe of adhesive. Additionally, upper portions of the return card are adhered by a plurality of transversely spaced, small adhesive dots. The recipient's address is printed through the opening onto the card simultaneously with imprinting an individualized salutation on the front face of the letter. The message may also be printed at the same time as the salutation and address, or the message may be preprinted. The letter and card may then be folded and placed in a window envelope, the recipient's address being visible through the envelope window.

16 Claims, 1 Drawing Sheet

RETURN CARD SYSTEM

BACKGROUND OF THE INVENTION

1. Field of the Invention

This invention relates generally to computer printed letters and return cards, and more particularly relates to a letter blank having an address window therein combined with a return card secured to the reverse side of the blank and placed to be visible through the window and imprinted simultaneously with the letter.

2. Description of the Prior Art

Many businesses rely on making customer contact through the mails and employ vast automatic addressing and mailing systems for this purpose. Conventionally, a computer-generated letter is imprinted with a message, which message can be generalized or personalized by using known computer printing techniques. If personalized, the inside address and salutation vary according to the addressee, but the message remains constant. In order to provide a convenient follow-up on the letter, a return card with the business address and pre-paid postage imprinted on one side is usually enclosed. Often the message side of the return card includes check lists or some other means for the recipient to indicate that he would like some follow-up information not provided in the letter message. The recipient's name and address can also be included on the message side and the card is used for addressing the follow-up reply by the initiating business. Thus, it is often necessary to imprint the prospective customer's name and address three times in each mailing: on the letter, on the return card, and on the envelope in which the letter is mailed. The many printings involved in such mailing are time consuming and costly.

More recently, improved return card and mailing systems have been developed wherein the return card was affixed to the reverse side of the computer letter directly behind an open address window. The card was affixed on the reverse side of the letter through an adhesively attached tear strip. The tear strip was usually secured to the letter by a plurality of rather widely spaced dots of glue. It has been found that the spaced glue dots sometimes could not tightly bind the tear strip to the letter and therefore, when the recipient would attempt to remove only the return card, the tear strip also became separated. Additionally, the glue dots created a bumpy interconnection wherein when the computerized letter was printed, the printed message would break up when the computer printer passed over the bumps or dots.

SUMMARY OF THE INVENTION

The improved return card system having an address window of the present invention is suitable for mass computerized automatic mailing and includes a letter form having an "address window". An insertion card (return card) is secured to the reverse side of the letter form in registry with the window whereby the card can be addressed simultaneously with the printing of the letter. Letterhead stock (blank with no inside address) is provided with a window which is positioned where the recipient's name and address is normally typed. The return card is attached to the reverse (non-message) side of the stock sheet in registry over the window. The name and address of the recipient can then be computer printed on the return card simultaneously with printing the salutation on the letter sheet, immediately above a previously printed message on the letter. Alternatively, the message, the salutation and the recipient's name and address may be printed at one time, for more complete personalization of the message. The letter together with the affixed return card is then folded and placed in a window envelope for mailing to the selected individual. By properly folding the letter, the name and address previously printed directly through the blank form window upon the return card can be positioned to show through the envelope window as the correct address of the letter.

One edge of the return card is firmly attached to the letter back by employing a separable, adhesive secured, tear strip or perforated tab. The adhesive pattern on the tab substantially covers the entire tab in a smooth adhesive stripe. Thus, when the return card is torn free at the perforation, the tab will remain on the letter back. Preferably, the adhesive stripe is positioned beneath the window opening on the letter back, and the tab area of the card is secured over the adhesive stripe. Additionally, the upper margin of the card preferably can be removably affixed to the back of the letter by employing three or four spaced small dots of releasable adhesive, for securing the return card to the back of the letter during the printing and mailing operations in a manner to permit easy removal of the return card when it is torn along the perforations.

It is therefore an object of this invention to provide an improved system for automatically and simultaneously printing a letter and addressing a return card rearwardly affixed to the letter.

It is further object of the invention to provide an improved return card system which eliminates the need for hand insertion of a return card and wherein the return card tab is affixed to the reverse side of the letter by a smooth, uniform stripe of adhesive. It is further object of this invention to provide an improved return card system which features improved methods for adhesively securing the return card to the computer printed letter.

It is yet another object of the invention to provide an improved return card system adaptable for efficient, personalized imprinting of both a letter and a return card.

These and other objects will be more readily ascertainable to one skilled in the art from a consideration of the following figures, description and exemplary embodiments, with the understanding that the drawings are illustrative only and that changes may be made in the specific construction illustrated and described within the scope of the appended claims.

DESCRIPTION OF THE PREFERRED EMBODIMENT OF THE INVENTION

Figure 1:
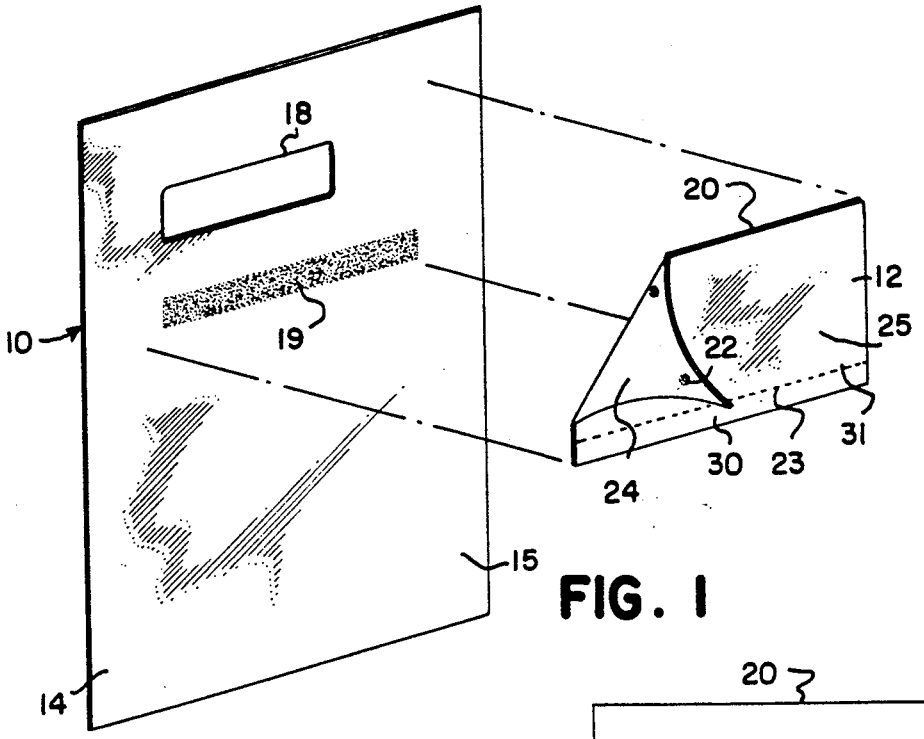
FIG. 1 is a rear, perspective, exploded view of the letter blank and return card of this invention.

Referring now to the drawings, and more particularly to FIG. 1, a letter blank/return card system 10 is illustrated, showing the rear (non-message) side 15 of the letter blank 14. The stock letter (blank) 14 may previously be imprinted with a letterhead 16 and includes a window opening 18. The window or opening 18 is in that area of the letter blank 14 where (on the message side 17 of the sheet) the inside address of the letter would normally be printed.

Figure 2:
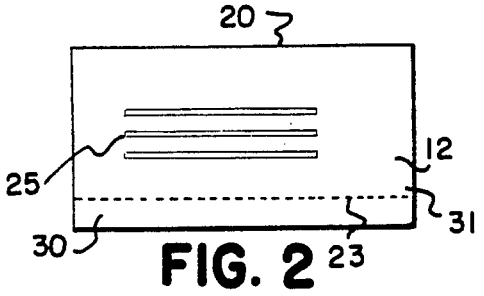
FIG. 2 is an elevational view of the return card of this invention.

The non-message side 15 of the letter blank 14 may include an adhesive stripe 19 for securing a tab portion 30 of the return card 12 to the reverse or rear side 15 of the letter blank 14. The return card 12 (sender address side 24 shown in FIG. 1 and the message side 25 illustrated in FIG. 2) includes a row of perforations 23 near the bottom edge 31 of the card 12. The card portion below the perforations 23 forms a separable tear strip 30 which is sized comparably with the adhesive stripe 19. When the return card 12 is placed in position rearwardly overfitting the window or opening 18, the glue stripe 19 will be substantially covered by the separable tear strip portion 30.

After delivery, in order to remove the return card 12 from the letter blank 14, the return card 12 must be torn along the perforations 23. The interaction between the adhesive stripe 19 and the tear strip 30 will cause the tear strip 30 to remain affixed to the letter blank 14 at the rear surface 15 thereof. To temporarily removably affix the top of the card 12 to the reverse side 15 of the letter blank 14, a small plurality of releasable, spaced, adhesive dots 22 are placed near the upper edge 20 of the card on that side which faces the letter blank. The dots 22 are quite small and serve to temporarily, weakly adhere the upper portion of the card to the reverse side of the letter. These adhesive dots 22 in combination with the action of the adhesively secured tear strip 30 serve to releasably, temporarily secure the return card 12 in proper position upon the rear side 15 of the blank 14 during the printing, folding and mailing operations. To remove the card 12 from the letter blank 14 after delivery, the top edge 13 of the card 12 can easily be urged or otherwise pulled from the printed letter package 10 to separate the upper portion of the card from the adhesive dots 22. The bottom of the card can then be torn along the perforations 23 with the severed tear strip portion 30 remaining adhered to the back of the printed letter.

Figure 4:
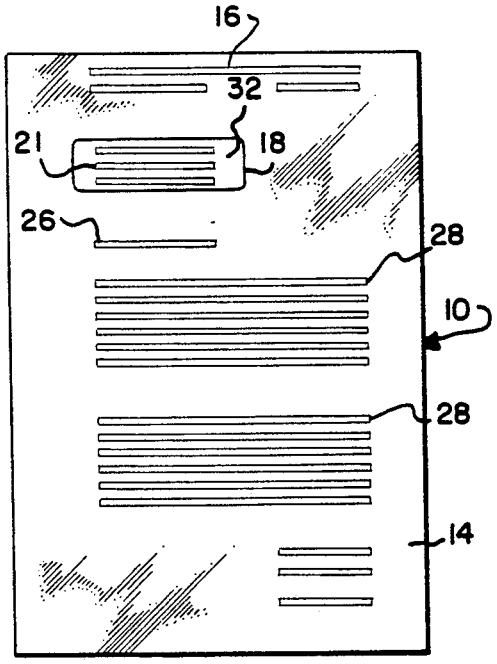
FIG. 4 is a front elevational view of the imprinted letter sheet and card.
Figure 3:
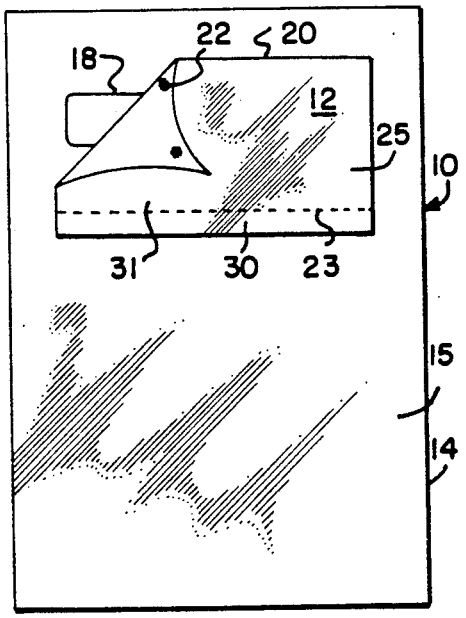
FIG. 3 is a rear elevational view showing the card in place on the back of the letter blank, a portion of the card being partially removed from the sheet.

Referring now to FIGS. 3 and 4, proper placement of the return card 12 and the interaction between the window opening 18 and the return card 12 is illustrated. For proper utilization of this invention, it is critical that the window or opening 18 be placed in that position where the inside address (recipient's address) of a letter is normally found. In use with computerized automatic printings, the return card 12 is previously imprinted with the desired message 25 and is adhered to the reverse side 15 of the blank form 14 by employing the combination of the upper, spaced, weak, glue dots 22 and the adhesively secured tear strip 30. (See FIG. 1). On the address side 24 of the return card 12, the area 32 for receiving the recipient's address is left blank.

The letter blank 14 may be previously printed with a letterhead 16 and a message 28 on side 17, but with the inside address and the salutation omitted. Alternatively, the letter blank 14 may contain only the previously printed letterhead. The card 12 is affixed to the rear (non-message) side 15 of the sheet, with the card address side 24 positioned over the window or opening 18 so that the space or area 32 for printing the recipient's address shows through the window or opening 18. The letter message side 17 can then be printed using known computer printing techniques with the inside address 21 (recipient's address) and personalized salutation 26 (recipient's name), the inside address 21 being printed through the window opening 18 directly onto the return card address side 24.

Alternatively, the prepared return card 12 can be positioned rearwardly over the window or opening 18 in the manner described above, but the entire message 28, salutation 26 and inside address 21 can be printed at the same time on the letter blank 14 and the return card 12 after the card is affixed, thereby reducing the number of steps required for automatically printing each personalized letter.

For optimal efficiency with a mass computerized automatic printing and mailing, the completed and combined letter/return card combination 10 is folded in known manner so that the recipient's address 21 is facing outwardly. The letter/card 10 is then placed in a conventional envelope of the type provided with a window whereby the recipient's address 21 will then be visible through the envelope window (not shown).

The combined card and letter sheet 10 comprises a letter blank 14 provided with a window or opening 18. A return card 12 is conventionally sized to at least overfit the window or opening 18. The return card 12 includes a plurality of laterally spaced, small releasable, pressure-sensitive adhesive dots 22 near the upper margin or edge 20 of the return card 12. The return card 12 also includes transversely extending linear perforations 23 near a bottom edge 31 of the return card 12 to define a tear strip 30. The portion (tear strip) 30 of the return card below the line of perforations 23 is affixed to the letter blank on the reverse side 15 thereof. A smooth adhesive stripe 19 of uniform thickness is placed on either the letter blank reverse side 15 proximate the bottom edge of the window or opening 18 or on the tear strip 30 of the return card on the address side 24 of the return card which faces the letter blank reverse or rear side 15.

The letter message side 17 is printed with a message 28 either before or after the return card 12 is attached. The personalized salutation 26 and the personalized recipient's address 21 are printed after the letter blank/return card combination is assembled.

The method for simultaneously printing a personalized letter and a personalized return card includes providing a stock letter blank 14 with a window or opening 18, providing a preprinted return card 12, and removably attaching the return card 12 to the letter blank 14 in registry behind the window or opening 18. The letter salutation and the return card portion 32 visible through window or opening 18 are simultaneously printed, the recipient's address being printed onto the return card 12 through the window or opening 18. The message 28 on the letter blank may be printed simultaneously with the printing of the recipient's address 21 or the letter message may be preprinted. The assembled letter/return card combination 10 is then folded so that the recipient's address 21 is facing outwardly. The finished, printed mailer is then placed in a window envelope with the recipient's address visible through the window of the envelope.

Having now illustrated and described my invention, it is not intended that such description limit this invention, but rather that this invention be limited only by reasonable interpretation of the appended claims.

What is claimed is:

1. A method for simultaneous printing of a letter and a return card, comprising the steps of:

(a) providing a stock letter blank with an address opening, the blank having a front face and a rear face;

(b) positioning a preprinted return card over the letter blank at the rear face thereof so that said card overfits said opening;

(c) securing the return card to said rear face by applying adhesive to vertically spaced and transversely spaced portions of one of the return card and said rear face;

(d) printing simultaneously said front face of the blank and said return card portion visible through said opening;

(e) folding said printed blank about said secured return card with said name and address folded outwardly;

(f) placing said printed blank and attached return card in a window envelope so that said name and address is visible through the window in the envelope;

(g) removing the printed blank from the window envelope and separating the return card from the rear face of the blank, said separating including separating the plurality of spaced, small adhesive dots without separating the continuous adhesive strip; and, (h) perforating the return card above the continuous adhesive stripe and separating the return card from the printed blank by tearing along the perforations.

2. A combined return card and letter, comprising:

a letter blank provided with an address opening, a front face and a rear face;

a return card sized to at least overfit said opening, said return card being adhered to the rear face of the blank so that a predetermined portion of the return card is visible through said opening, said return card having an upper edge and a lower edge, a releasable adhesive comprising at least one small dot applied to the return card near the upper edge, said return card being provided with linear perforations near said bottom edge, the perforations defining a bottom tear strip, the tear strip portion of the return card below said perforations being affixed to the rear face of the letter blank; and an adhesive strip on one of said rear face of the letter blank and said return card bottom tear strip for holding said return card to said letter blank;

wherein when said letter blank is printed, the recipient's address can be printed through said opening onto the return card and the return card can be removed for reply by tearing along said perforations, the bottom tear strip portion of said card remaining affixed to said letter blank.

3. The combination return card and letter according to claim 2 wherein said adhesive stripe is positioned on said letter sheet rear face proximate to and below said opening.

4. The combination return card and letter according to claim 2 wherein said letter blank further comprises printed materials on the front face of said blank.

5. The combination return card and letter according to claim 2 wherein said releasable adhesive comprises a plurality of spaced, small adhesive dots to temporarily secure a portion of the return card which is spaced from the tear strip to the rear face of the letter blank.

6. The combination return card and letter according to claim 1 wherein said adhesive stripe is smooth and of uniform thickness.

7. The combination return card and letter according to claim 5 wherein the adhesive dots are transversely spaced on the return card.

8. The combination return card and letter according to claim 6 wherein said releasable adhesive comprises a plurality of spaced, small adhesive dots the dots being upwardly spaced from the smooth, uniform thickness, adhesive strope.

9. The combination return card and letter according to claim 8 wherein the adhesive dots are transversely spaced on the return card.

10. A method for simultaneous printing of a letter and a return card, comprising the steps of:

(a) providing a stock letter blank with an address opening, the blank having a front face and a rear face;

(b) positioning a preprinted return card over the letter blank at the rear face thereof so that said card overfits said opening, the return card having a tear strip defined by perforations;

(c) securing the return card to said rear face by applying adhesive to vertically spaced and transversely spaced portions of one of the return card and said rear face, including applying the adhesive in a continuous stripe at the tear strip, and also applying the adhesive in a plurality of spaced, small dots in transversely spaced locations spaced from the tear strip; and, (d) printing simultaneously said front face of the blank and said return card portion visible through said opening.

11. The method according to claim 10 wherein the printing on the front face of the blank comprises a salutation and the printing on the return card comprises a name and address.

12. The method according to claim 11 wherein the printing further comprises printing a message on said letter simultaneously with printing the said salutation and name and address.

13. The method according to claim 10 and the further steps of:

(e) folding said printed blank about said secured return card with said name and address folded outwardly.

14. The method according to claim 13 and the further step of:

(f) placing said printed blank and attached return card in a window envelope so that said name and address is visible through the window in the envelope.

15. The method according to claim 14 and the further step of (g) removing the printed blank from the window envelope and separating the return card from the rear face of the blank.

16. The method according to claim 15 wherein the separating comprises separating the plurality of spaced, small adhesive dots without separating the continuous adhesive stripe.

* * * * *